US005964226A

United States Patent [19]

Sobel

[11] Patent Number: 5,964,226

[45] Date of Patent: Oct. 12, 1999

[54] HAIR PRODUCT APPLICATION SYSTEM

[76] Inventor: Joan Lasker Sobel, 620 Camino Rancheros, Santa Fe, N.Mex. 87501

[21] Appl. No.: 08/928,270

[22] Filed: Sep. 12, 1997

[51] Int. Cl.[6] ..... A45D 34/04

[52] U.S. Cl. ..... 132/108; 132/317; 132/313; 132/314; 401/199

[58] Field of Search ..... 132/208, 108, 132/109, 110, 111, 112, 113, 114, 115, 221, 313, 317, 314, 320; 401/198, 199, 261, 262, 263, 283

[56] References Cited

U.S. PATENT DOCUMENTS

| | | | |
|---|---|---|---|
| 2,458,063 | 1/1949 | Dulberg | 132/314 |
| 2,652,030 | 9/1953 | Stiefel et al. . | |
| 2,658,479 | 11/1953 | Fried . | |
| 2,713,848 | 7/1955 | Miessner . | |
| 2,922,395 | 1/1960 | Baun . | |
| 2,939,615 | 6/1960 | Lerner | 132/112 |
| 2,964,770 | 12/1960 | Lerner et al. | 132/108 |
| 3,127,630 | 4/1964 | La Mura . | |
| 3,231,924 | 2/1966 | Lofgren . | |
| 3,238,927 | 3/1966 | Rubissow . | |
| 3,545,874 | 12/1970 | Schwartzman . | |
| 3,677,271 | 7/1972 | Luciano | 132/314 |
| 3,684,389 | 8/1972 | Eron et al. . | |
| 3,861,407 | 1/1975 | Gabriele . | |
| 3,863,650 | 2/1975 | De Maria . | |
| 3,887,287 | 6/1975 | Rosh, Jr. . | |
| 3,941,491 | 3/1976 | Mutschler . | |
| 4,017,871 | 4/1977 | Hubbard . | |
| 4,100,549 | 7/1978 | Hubbard . | |
| 4,207,909 | 6/1980 | Wilcher . | |
| 4,273,144 | 6/1981 | Morganroth . | |
| 4,306,818 | 12/1981 | Manusch . | |
| 4,359,291 | 11/1982 | Lum . | |
| 4,468,147 | 8/1984 | Manusch et al. . | |
| 4,518,273 | 5/1985 | Larizza . | |
| 4,545,819 | 10/1985 | Shioi et al. . | |
| 4,585,018 | 4/1986 | O'Connor | 132/112 |
| 4,588,319 | 5/1986 | Niemeyer . | |
| 4,597,683 | 7/1986 | Wittersheim et al. . | |
| 4,652,163 | 3/1987 | Karliner et al. . | |
| 4,653,949 | 3/1987 | Larizza . | |
| 4,722,459 | 2/1988 | Goncalves . | |
| 4,723,859 | 2/1988 | Kitoh | 401/199 |
| 4,727,893 | 3/1988 | Goncalves | 132/320 |
| 4,783,185 | 11/1988 | Erismann et al. . | |
| 4,867,183 | 9/1989 | Busch et al. . | |
| 4,902,151 | 2/1990 | Asano et al. . | |
| 4,913,172 | 4/1990 | Chou | 132/221 |
| 4,958,647 | 9/1990 | Busch et al. . | |
| 4,966,175 | 10/1990 | Kimura et al. . | |
| 4,969,765 | 11/1990 | Nagai . | |
| 4,973,181 | 11/1990 | Jankewitz | 401/199 |
| 4,974,982 | 12/1990 | Nielson . | |
| 4,993,437 | 2/1991 | Kimura et al. . | |
| 5,035,251 | 7/1991 | Hollenberg et al. . | |
| 5,044,803 | 9/1991 | Kurosawa et al. . | |

(List continued on next page.)

FOREIGN PATENT DOCUMENTS

| | | | |
|---|---|---|---|
| 2006869 | 6/1990 | Canada . | |
| 2248549 | 4/1992 | United Kingdom | 401/283 |
| WO 90/07290 | 7/1990 | WIPO . | |

*Primary Examiner*—Todd E. Manahan
*Attorney, Agent, or Firm*—Kenyon & Kenyon

[57] ABSTRACT

A hair product application system includes a main body defining a reservoir which contains a hair product or hair coloring substance, an integral applicator having a first portion disposed inside the reservoir and a second portion disposed through an opening to the outside of the main body, and a cap adapted to cover the second portion of the applicator and sealingly attach to the main body. The applicator transports the hair product from the reservoir to the outer surface of the second portion of the applicator by capillary action, from where the hair product may be transferred by direct contact to the hair to be treated.

27 Claims, 7 Drawing Sheets

U.S. PATENT DOCUMENTS

| | | | |
|---|---|---|---|
| 5,076,298 | 12/1991 | Busch et al. . | |
| 5,094,254 | 3/1992 | Krueckel et al. | 132/320 |
| 5,119,838 | 6/1992 | Nakazima | 132/112 |
| 5,137,388 | 8/1992 | Kimura . | |
| 5,152,305 | 10/1992 | Niv . | |
| 5,154,193 | 10/1992 | Busch et al. | 401/199 |
| 5,161,906 | 11/1992 | Eppler . | |
| 5,215,106 | 6/1993 | Choi | 132/109 |
| 5,306,092 | 4/1994 | Jenq . | |
| 5,343,880 | 9/1994 | McKay | 132/211 |
| 5,344,670 | 9/1994 | Palmer et al. . | |
| 5,362,167 | 11/1994 | Loftin et al. . | |
| 5,362,168 | 11/1994 | Abe et al. . | |
| 5,368,405 | 11/1994 | Sixiong . | |
| 5,590,971 | 1/1997 | Melnick . | |
| 5,655,554 | 8/1997 | Goldberg | 132/314 |
| 5,676,480 | 10/1997 | Tosto | 132/211 |

HAIR PRODUCT APPLICATION SYSTEM

FIELD OF THE INVENTION

The present invention relates to the field of hair care, and more particularly to an apparatus and method for applying a hair product, such as hair coloring, to hair.

BACKGROUND INFORMATION

Dispensers and applicators for hair dye and hair care cosmetics are generally known in the art. For example, U.S. Pat. No. 5,152,305 purportedly discloses an apparatus for applying dye to hair which includes a tubular housing with an end cap that has a nozzle and stem for applying the dye to the hair. The housing contains a movable piston which the user may actuate to compress and thereby extrude the hair dye through the nozzle.

U.S. Pat. No. 5,076,298 purportedly discloses a device that includes a tubular element containing multiple storage compartments, each compartment containing an absorbent material. The absorbent materials may each contain a different component of a hair dye solution. The hair dye component is provided from each of the absorbent materials to multiple tines where the components are mixed together. The mixture may then be applied from the tines to the hair to be dyed.

U.S. Pat. No. 4,966,175 purportedly discloses an apparatus having a cylindrical body with a storage chamber for storing a liquid hair dye and a supply means or valve means connecting the storage chamber to a top portion. The top portion has small holes that lead to the exterior of the cylindrical body through which the hair dye passes. The hair dye is distributed onto brush members from which the dye may be transferred to the hair to be treated.

U.S. Pat. No. 4,958,647 purports to disclose a hair dye dispenser containing a motor that rotates an absorbent material to thereby transfer by centrifugal force hair dye from the absorbent material to a second absorbent material located radially outward from the first absorbent material. The second absorbent material is disposed external to the dispenser for applying the hair dye to the hair.

The methods and devices known in the art fail to provide an apparatus or method as disclosed herein for applying hair products, such as hair dye, to hair in a manner that is simple to use, reliable, and inexpensive to manufacture that can be used as a disposable unit, or alternatively can be adapted to be simply refillable.

OBJECT AND SUMMARY OF THE INVENTION

An object of the present invention is to provide an apparatus that includes a main body portion having an inside adapted to receive a hair product or hair coloring substance, an outside, and an opening or port by which the inside communicates with the outside. The device includes a wick or applicator tip disposed in the opening, the wick having a first end disposed on the inside of the main body and a second end disposed outside of the main body, and a cap adapted to cover the second end of the wick and to sealingly connect to the main body.

Another object of the present invention is to provide a device that can be easily used and instantly accessible, without the need to mix or pour components or ingredients, for coloring hair with any color desired. For example, any desired hair coloring may be used in the container according to the present invention, access to the hair coloring being via, for example, an opening in the container that has a wick that dispenses the hair coloring contained within the container. The container may also be shaped to provide easy manipulation of the container by the user. The shape of the container is not restricted to elongated cylindrical shapes, but may encompass any shape, including without limitation, shapes and designs that may be fanciful, ergonomic, functional, and/or stylized.

It is a further object of the present invention to provide a superior means of touching up hair coloring, particularly in the area of roots, as a short-term expedient for example, by providing a convenient container with a convenient application means that allows users to easily place hair coloring to specific locations of hair. In addition, the device may be used to easily apply accent streaking.

In one embodiment of the present invention, means for applying the hair coloring product to hair includes a wick that provides capillary action through which the hair coloring product may be transported from inside the container to the hair.

In another embodiment of the present invention, the opening of the main body of the apparatus may include a removable fitting or collar. The collar attaches to the main body by a removable means such as threads, interlocking grooves, or press fit. A wicking type applicator is disposed through the collar so that one end of the applicator is internal to the main body and the other end of the applicator is external to the main body. Since the collar is removable, the main body may be filled and refilled with a hair coloring substance. In an alternative configuration, the main body may be filled through an opening at the bottom of the device. The bottom opening is preferably sealable, the seal created by, for example, a threaded connection between a sealing plug and the main body portion, interlocking grooves, or press fit. The sealing plug may be bonded in place, for example, with adhesive, electrostatic seal, or heat seal.

In a further embodiment of the present invention, an applicator section of the device is substantially separated from a reservoir section by, for example, a valve. The valve allows the hair product to pass from the reservoir section to the applicator section of the device upon some action by the user. For example, the user may push a lever, press the tip of the applicator inward toward the body, or push the sides of the main body together in order to open a passage through which the hair product may pass. This permits, for example, a non-homogeneous hair product, or a hair solution that is prone to separation, to be shaken and mixed immediately before it enters the wicking applicator section of the device. Upon entering the applicator section, the mixed hair solution may be transported by capillary action of the wicking applicator to the hair. The non-used portion of the hair solution, which may be prone to separation, remains in the reservoir section separated from the wick by the valve so that the wick will not absorb separated solution. This aids in preventing the wick from, for example, delivering an unbalanced amount of one component of the hair solution to the hair.

An advantage of a valved configuration is that a hair solution that consists of two or more components that tend to separate can be contained within a single applicator and will not require external mixing or pouring. Additionally, a user may fill the reservoir with components of the user's choosing. For example, the applicator system of the invention allows for a user to follow a simple filling operation by which a multi-component solution, or two different components of a solution, may be added to the reservoir. Once the reservoir has been filled, it may be sealingly closed. Thus, multi-component solutions are simply stored and easily accessed without further external mixing or pouring.

The present invention is also directed to a method of coloring hair using the hair product application device described above which includes the steps of removing a cap from a main body of the hair product application device to expose the wick; applying the wick to hair to thereby transfer hair care solution from the wick to the hair; and replacing the cap over the wick and further engaging the cap with the main body of the hair product application device to thereby form a substantially air tight enclosure between the cap and the main body so that the wick is stored in a substantially air tight enclosure.

An advantage of the present invention is that it integrates the applicator with the reservoir, providing a mechanically simple, easy-to-use device for coloring hair that may be disposable or refillable, is not cumbersome to use, does not create a mess, and avoids leakage or spillage. Thus, the device avoids problems associated with available hair coloring instruments, especially those, for example, that rely upon separate, detachable applicators. The present invention is also inexpensive to manufacture.

These and other objects, characteristics, and advantages of the present invention will become apparent in view of the description and accompanying drawings that follow.

DETAILED DESCRIPTION

Figure 1:
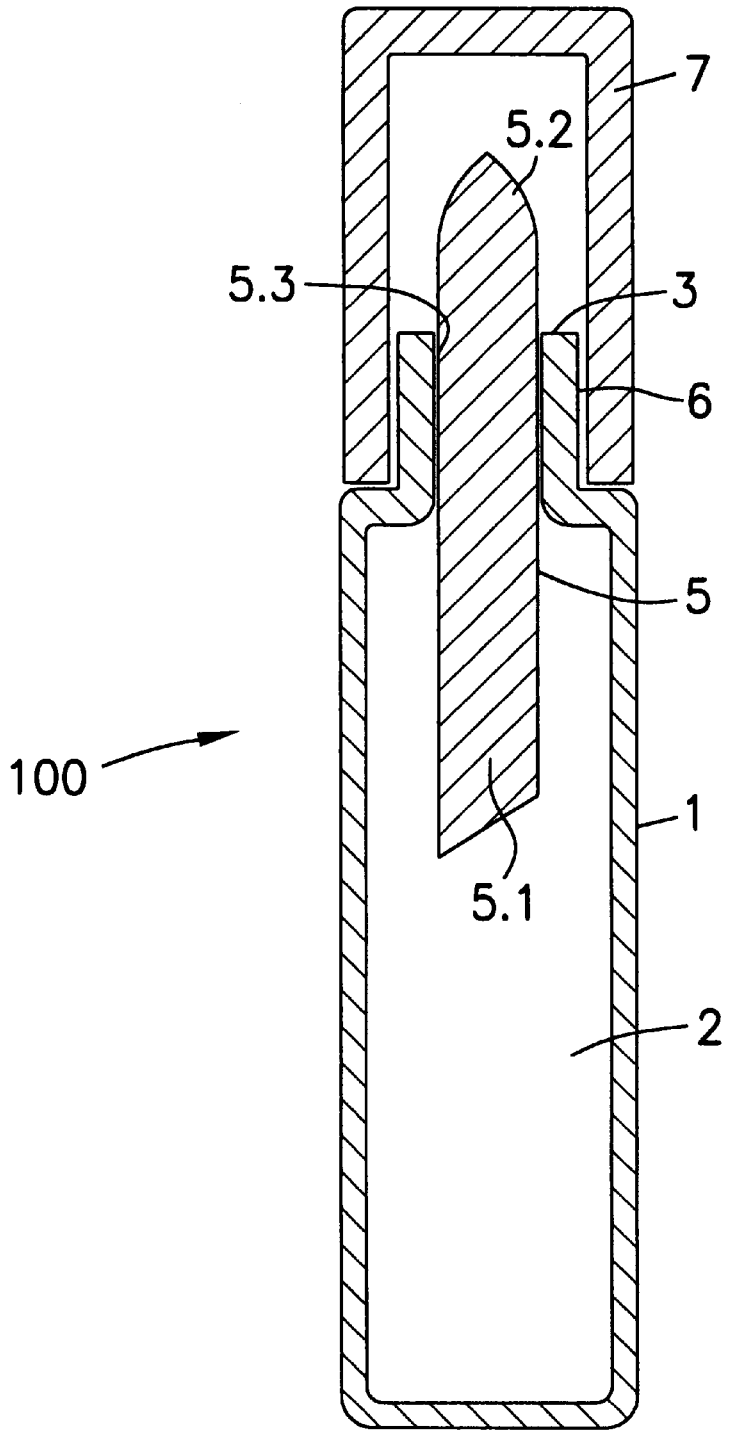
FIG. 1 is a sectional view of a hair product application device according to an embodiment of the present invention.

FIG. 1 shows a first exemplary embodiment of the present invention, designated generally as device 100, having a main body 1 that defines a reservoir 2. The reservoir 2 is a substantially closed region having an opening 3 through which a hair product or hair care solution can be delivered from the device 100 to the hair. The hair product or hair care solution may include, for example, hair coloring substances such as permanent, semi-permanent, washable, or leave-in hair dye, hair bleach, hair frosting, or other solutions for the treatment of hair, such as conditioners or setting solutions. A wick or applicator tip 5, which is partially contained within the reservoir 2 and partially outside the reservoir 2, interacts with the inside of the reservoir 2 in order to absorb hair care solution and deliver it to the outside of the reservoir 2, for example, by capillary action.

The opening 3 of the reservoir 2 may be adapted to receive the applicator tip 5. The applicator tip 5 may be, for example, felt, fibre, sponge rubber, or any other material capable of wicking a hair care solution from the reservoir 2 to the outer surface of the applicator tip 5 by capillary action. The applicator tip 5 is disposed in the opening 3 of the reservoir 2 having a first portion 5.1 of the applicator tip 5 inside the main body 1 and second portion 5.2 exposed outside the main body 1. The applicator tip 5 should fit properly within the opening 3 so that air pressure can equalize between the outside and the inside of the reservoir 2. This may also be accomplished by properly shaping the applicator tip 5 with a groove 5.3 or other opening to accomplish the pressure equalization. Allowing pressure equalization may, for example, avoid a pressure differential that hinders the flow of hair care solution through the applicator tip 5 from the inside to the outside of the reservoir 2.

The applicator tip 5 should fit, for example, so that it will not be inadvertently pushed down into the reservoir 2, and so that hair care solution within the reservoir 2 may not leak past the applicator tip 5, but rather, may pass out of the reservoir 2 by, for example, capillary action of the wicking applicator tip 5. The opening 3 may include a neck portion 6 that surrounds the applicator tip 5 and provides support thereto.

The opening 3 is preferably adapted to receive a cap 7. The cap 7 preferably makes a substantially air tight connection with the main body 1 to prevent drying of the wicking applicator tip 5 and to prevent evaporation, leakage, or spillage of the hair care solution contained within the main body 1. Suitable connections between the cap 7 and the main body 1 include, for example, parallel interlocking grooves, threads, and press fit. When the cap 7 is placed on the main body 1, the cap substantially covers the applicator tip 5 such that the device is not in an operable state. The cap 7 prevents inadvertent contact between the applicator tip 5 and surfaces upon which it is not desirable to place the hair care solution.

Figure 2:
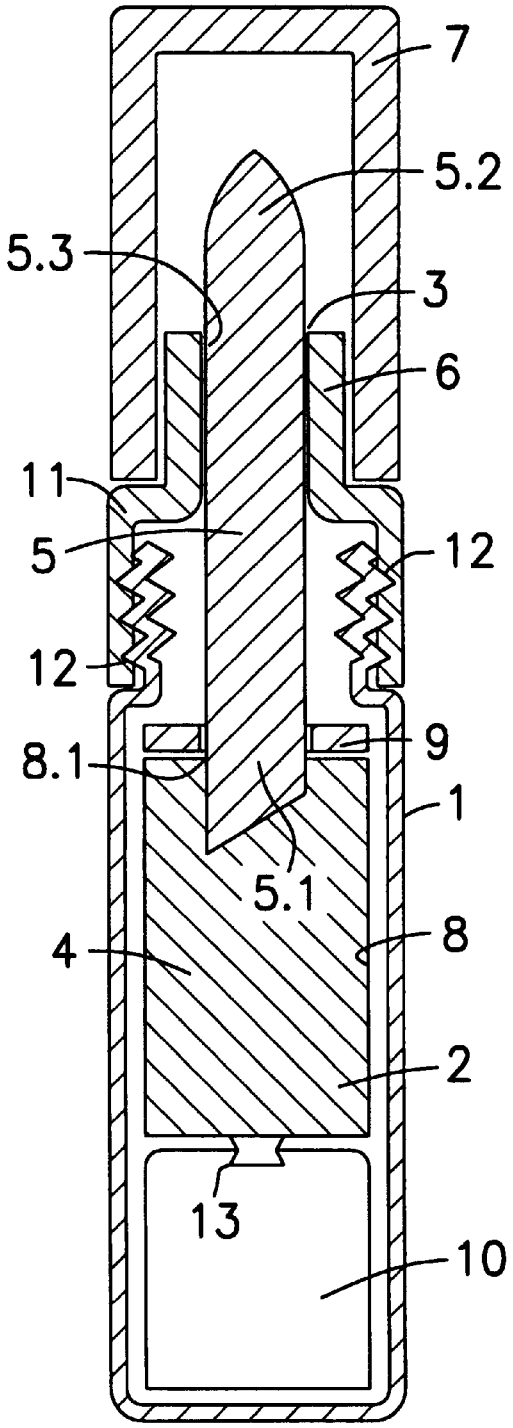
FIG. 2 is a sectional view of a hair product application device according to a second embodiment of the present invention.

The device may optionally contain a number of features as shown in FIG. 2. For example, the reservoir 2 may contain an absorbent material or absorbent pad 4 that absorbs and holds the hair care solution. The absorbent pad 4 may substantially fill the reservoir 2 and may serve to absorb the hair care solution to help prevent spilling or leaking of the solution.

An additional feature of the device provides that the opening 3 and optional neck portion 6 are contained on a removable collar 11. The collar 11 may join to the main body 1 by, for example, a threaded connection 12 as shown in FIG. 2. The removable collar 11 may facilitate the filling and refilling of the device with hair care solution. A further option for filling or refilling the device includes having a filler opening 13 at the bottom of the main body 1. The filler opening 13 may join and seal with the main body 1 by a threaded fit, press fit, or an electrostatic or heat sealing fit.

The main body 1 may optionally contain a liner or casing 8 which substantially surrounds the hair care solution. The casing should have an aperture 8.1 through which the hair care solution may pass. The aperture 8.1 may, for example, coincide or line up with opening 3 of the main body 1 so that the applicator tip 5 may pass through the opening 3 and the aperture 8.1. The casing 8, which is disposed within the main body 1, provides a barrier to the hair care solution, and may be constructed of a flexible material. The casing 8 is preferably made of a material that will not react with the hair care solution contained therein, such as, for example, plastics, rubbers, and synthetics as are known in the art, as well as ceramics and some metals. The choice of material for the casing 8 will depend in part on the composition of the hair care product. Thus, while the main body may be formed of any number of suitable materials such as moldable plastics, ceramics, synthetics, and the like, as are known in the art, the main body 1 may be also be made of materials that would otherwise be unsuitable due to a tendency to react with the chemical composition of hair products or hair care solutions. For example, the main body 1 could be formed from a metallic material that might be reactive with the hair care product, but, because the main body 1 can be substantially separated from the hair care solution by the casing 8, contamination or chemical reaction with the hair care solution is prevented. Further, the main body 1 may be any shape, whether functional or fanciful, regardless of the desired shape for the casing 8.

A retainer ring 9 may be incorporated into the device according to the present invention, adapted to fit snugly around a portion of the applicator tip 5 so that the retainer ring 9 positions and holds the applicator tip 5 within the reservoir 2 and prevents the applicator tip 5 from being inadvertently pushed into the reservoir 2. The retainer ring 9 may, for example, provide a means of positioning the applicator tip 5 within the main body 1, for example, in a centered position as shown in FIG. 2. It may be advantageous to construct the retainer ring 9 to cooperate with the casing 8 so that the casing 8 is held sealingly around the applicator tip 5 by the retainer ring 9. Also, the retaining ring 9 may be held relative to the main body 1 in a substantially fixed position, such as by a groove or boss in the side of the main body 1 that prevents longitudinal movement of the retainer ring 9.

In a further embodiment of the present invention, a spacer 10 may be adapted to fit within the main body 1. The spacer 10 takes space out of the main body 1 that would otherwise be filled with hair care solution. Thus, use of the spacer provides for independence between the size and shape of the main body 1 and the size and shape of the reservoir 2. By using a spacer 10, the volume of liquid contained within the reservoir 2 may be independent of the volume occupied by the main body 1. The spacer 10 may merely be, for example, an empty space formed within the main body 1 by virtue of the shape of the main body 1.

Figure 3B:
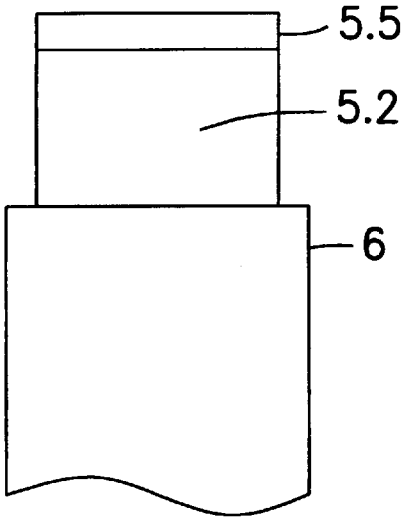
FIG. 3*b* is a front view of a beveled tip of a hair product application device according to a fourth embodiment of the present invention.
Figure 3C:
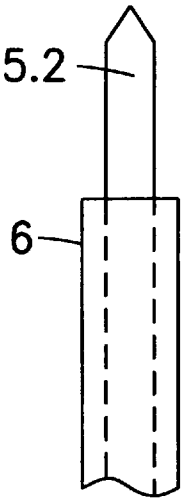
FIG. 3*c* is a side view of a serrated or beveled tip of a hair product application device.
Figure 3A:
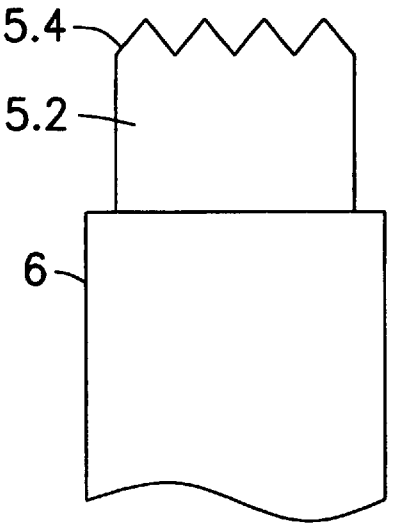
FIG. 3*a* is a front view of a serrated tip of a hair product application device according to a third embodiment of the present invention.

FIG. 3*a* shows an alternate embodiment of the applicator tip 5 extending from the neck 6 of the hair product applicator system according to the present invention. The second portion 5.2 of the applicator tip 5 has a serrated tip 5.4. The serrated tip 5.4 provides an alternative configuration for applying the hair care solution from the reservoir 2 to the hair.

FIG. 3*b* shows another embodiment of the applicator tip 5. The second portion 5.2 has a beveled tip 5.5 which may be used to apply the hair product to the hair. FIG. 3*c* shows a side view of the applicator tip 5. The side view of FIG. 3*c* represents a side view for both the serrated tip 5.4 of FIG. 3*a* and the beveled tip 5.5 of FIG. 3*b*.

Figure 4:
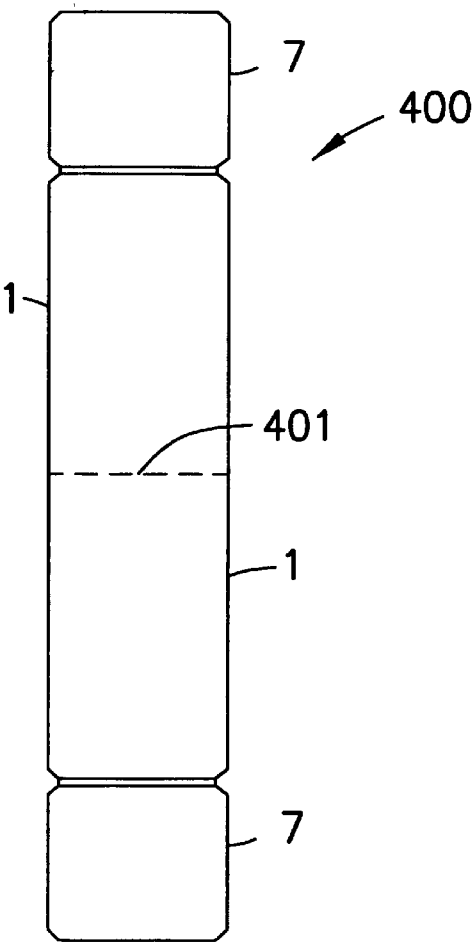
FIG. 4 is a side view of a hair product application device according to a fifth embodiment of the present invention.

FIG. 4 shows an embodiment of the present invention wherein two hair care applicator systems are joined to form a single unit. The dual construction device 400 shown in FIG. 4 includes, for example, two parts separated by a partition 401. In one embodiment of the dual construction device 400, each part is substantially as described with reference to FIGS. 1 or 2. That is, each part of the dual construction device 400 may contain a main body 1 which includes a reservoir 2, a wick applicator tip 5, a cap 7 and any of the other features shown in FIGS. 1, 2, and 3. The partition 401 separates the two parts of the dual construction device 400. The two parts may be, for example, joined together mechanically or integrally formed as a single piece of material, such as a moldable plastic.

The dual construction device 400 is suitable to provide a convenient way of having, for example, two colors of hair dye accessible for a user. It may provide a device that can deliver two components of hair care solution separately, for hair care products that require a two-stage application with a separate component applied for each stage. The dual construction device 400, allowing separate components to be placed in the opposite parts, provides a suitable device for such a purpose.

Figure 5:
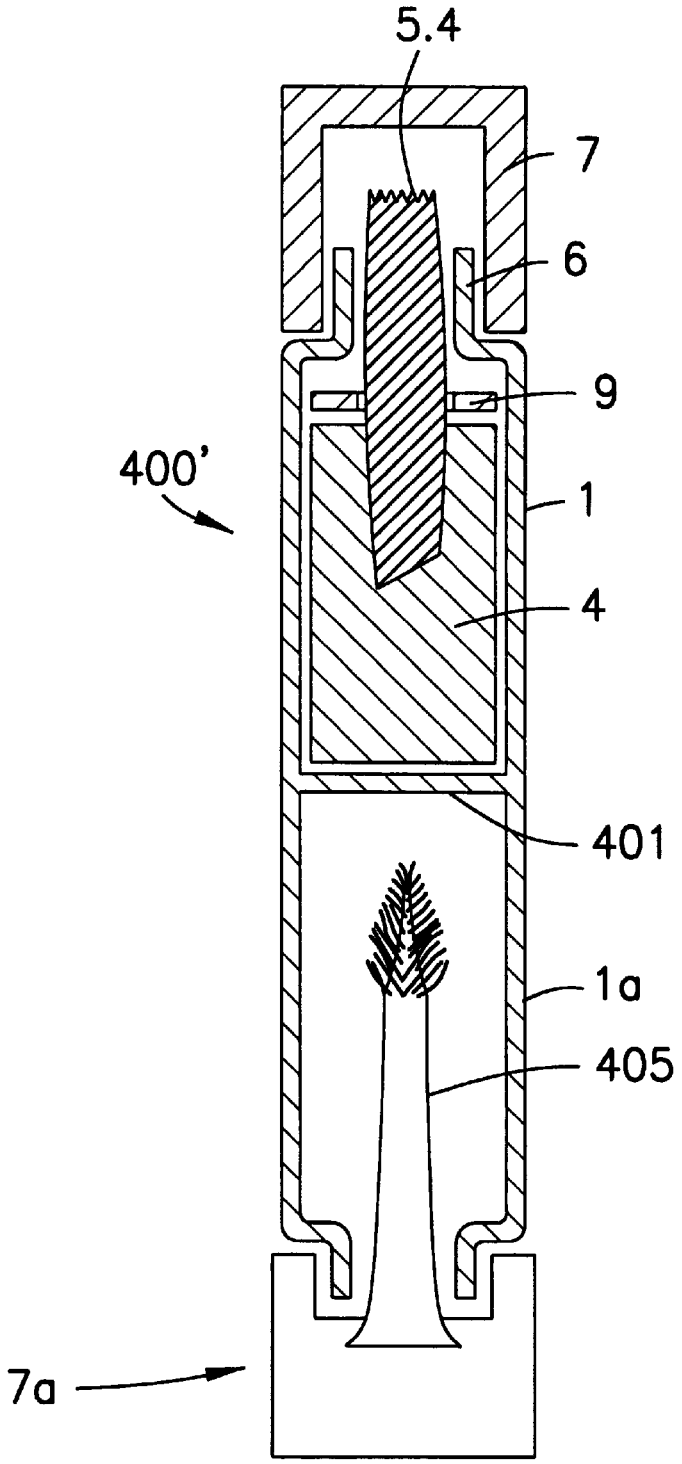
FIG. 5 is a sectional view of an alternative to the hair product application device of FIG. 4.

FIG. 5 shows a second embodiment of a dual construction device 400', in which the first part of the dual construction device 400', may be, for example, a utility compartment 1*a* rather than a hair product applicator as described above. The utility compartment 1*a* may have, for example, a press-fit cap or screw-on top 7*a*. The cap or screw-on top 7*a* may further include, for example, an applicator brush 405 adapted for insertion into the utility compartment 1*a*. Thus, the dual construction device 400' according to this alternative embodiment provides a device having two cosmetic devices packaged together for convenient access by a user. The utility compartment 1*a* may be adapted to receive, for example, nail polish, mascara, or other cosmetic products. The cosmetic product in the utility compartment 1*a* may be applied with the applicator brush 405 adapted to the cap 7*a* of the utility compartment. Thus, rather than the dual construction device 400 of FIG. 4 that contains two independent hair care devices similar to those described with reference to FIGS. 1 and 2, the present invention provides a dual construction device 400' that contains a hair care device similar to FIGS. 1 or 2 coupled to a utility cosmetic device for cosmetics such as nail polish, mascara, or the like.

Figure 6B:
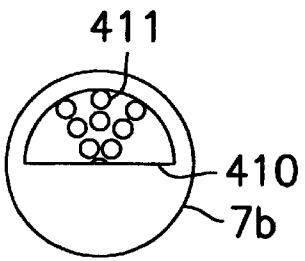
FIG. 6*b* is a top view of the hair product application device of FIG. 6*a* in an open position.
Figure 6C:
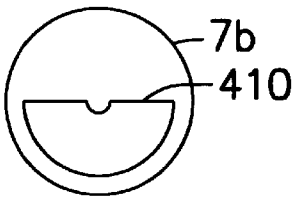
FIG. 6*c* is a top view of the hair product application device of FIG. 6*a* in a closed position.
Figure 6A:
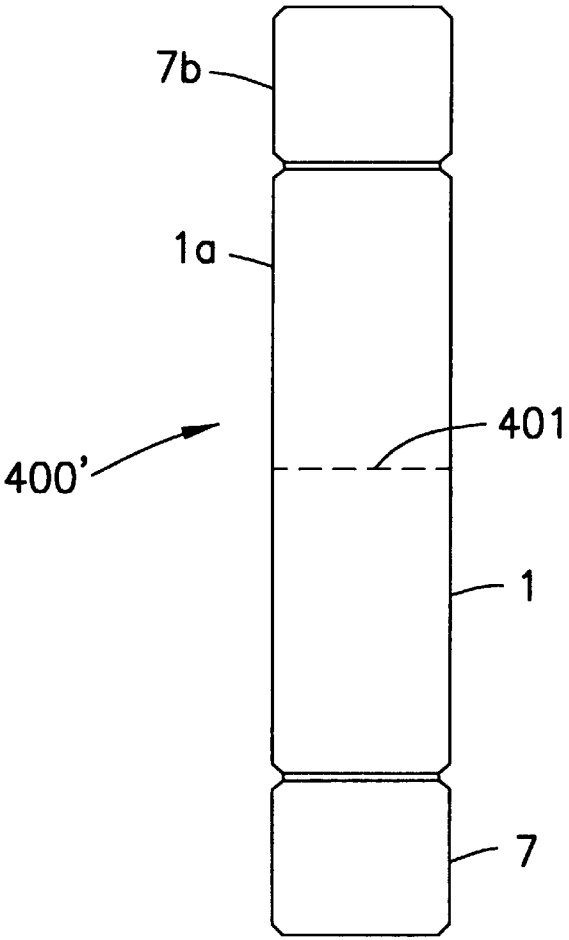
FIG. 6*a* is a side view of a hair product application device according to a further embodiment of the present invention.

FIG. 6*a* shows an exemplary embodiment of the dual construction hair care device 400' in which one part of the dual construction device is configured as FIGS. 1, 2, or 3, while the other part is a utility compartment 1*b* capable of storing and dispensing a sparkling metallic-like substance or glitter that can be placed in the hair or on the skin. The small sparkling metallic-like substance or glitter may be the only component in the utility compartment 1*b*, or alternatively, the metallic-like substance may be suspended in a liquid or gel medium to facilitate the application thereof. The utility compartment 1*b* may be equipped with a special lid 7*b* for dispensing the glitter. The lid 7*b* rotates on the utility compartment 1*b* from an open position as shown in FIG. 6*b* to a closed position as shown in FIG. 6*c*. In the open position of FIG. 6*b*, a large opening 410 in the lid 7*b* exposes multiple small openings 411 that are in communication with the inside of the utility compartment 1*b*. In the closed position shown in FIG. 6*c*, the large opening 410 has been rotated upon the utility compartment 1*b* such that the small openings 411 are no longer exposed.

Figure 7:
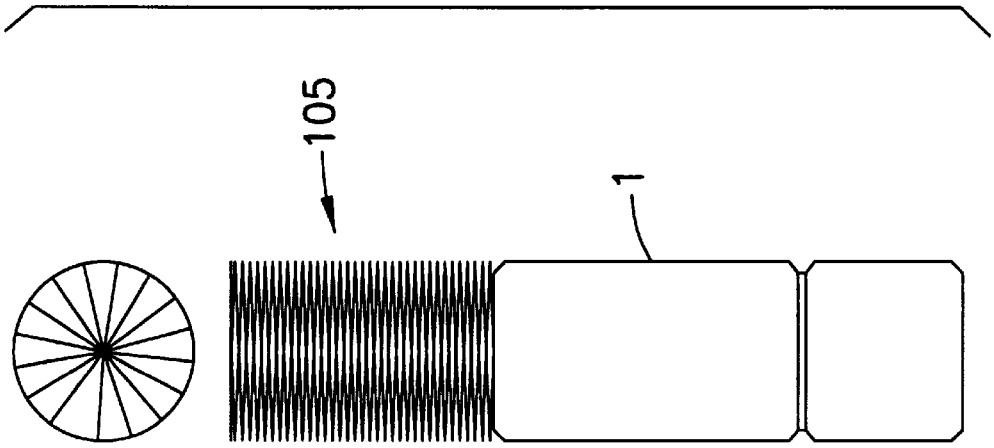
FIG. 7 is a side view of a hair product application device according to another embodiment of the present invention.

As shown in FIG. 7, yet another embodiment according to the present invention provides a hair care device substantially as described with reference to FIGS. 1, 2 or 3 further including a brush 105 integrally joined to the device. The embodiment of FIG. 7 provides the convenience of having the hair care device and the utility of the brush in a single unit. The main body 1 may function as a handle when using the brush 105 and further, the brush 105 may be integrally attached and formed as part of the main body 1.

Figure 9:
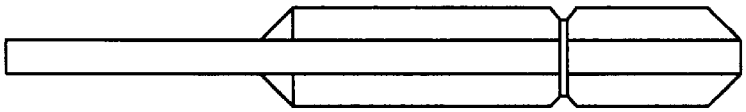
FIG. 9 is a front view of the hair product application device of FIG. 8.
Figure 8:
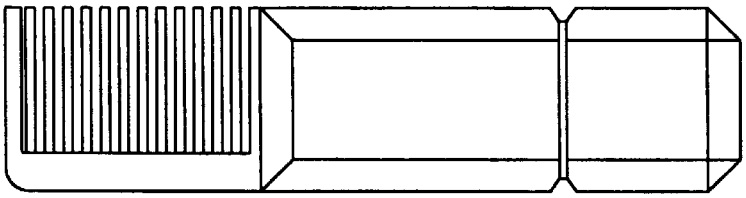
FIG. 8 is a side view of a hair product application device according to a still further embodiment of the present invention.

FIG. 8 shows an alternative configuration of the device having a comb 110 integrally attached to the main body 1 of the device. The comb 110 may, for example, be attached to the end of the device wherein the device acts as a handle for the comb 110. FIG. 9 shows a front view of the device of FIG. 8.

Figure 10:
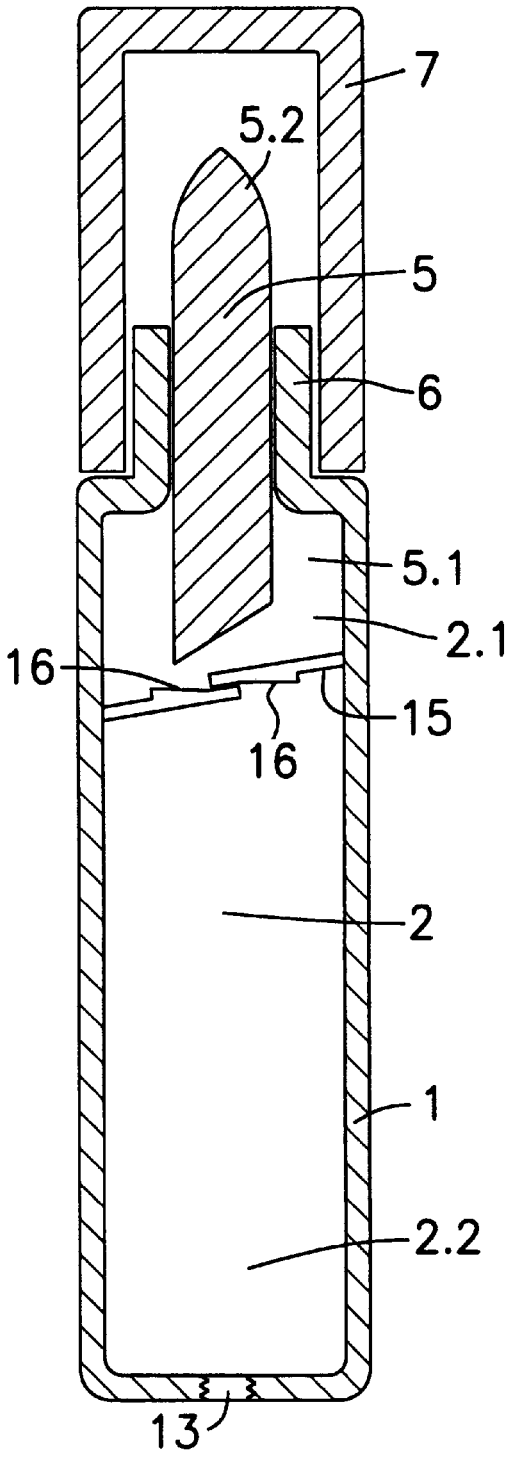
FIG. 10 is a sectional view of a hair product application device according to another embodiment of the present invention

FIG. 10 shows an embodiment of the present invention having a valve 15 which separates the reservoir 2 into two compartments 2.1 above the valve, and 2.2 below the valve. Hair care solution from compartment 2.2 may pass through the valve 15 upon, for example, the user squeezing the sides of the main body 1. In the exemplary valve shown, squeezing the sides of the main body 1 in the region of the valve 15 will draw opposing sides of the valve 15 together causing the opposing sides to ride onto opposing ramps 16 which thereby separate the opposing sides to provide a passage way for the hair care solution. The valve 15 may be a separate element that is placed into the main body 1, or it may be integrally constructed as part of the main body, for example, through an injection molding process. The valve 15 having ramps 16 shows an exemplary embodiment. Different kinds of valves having different actuating means may be used to separate the reservoir 2 into compartments 2.1 and 2.2, the different valves being within the spirit and scope of the invention.

In operation, each embodiment of the hair product application system according to the present invention discussed above provides a hair product to the hair by a user removing the cap 7 to expose the applicator tip 5. Wicking action of the applicator tip 5 provides a hair product from the first portion 5.1 of the applicator tip 5 contained within the reservoir 2 to the second portion 5.2 of the applicator tip 5. The user may apply the hair product to the hair to be treated by touching the hair with the applicator tip 5. The applicator tip 5 may be used to apply a hair product in any number of styles, for example, contacting substantially all the hair on a person's head through repeated strokes of the applicator tip 5, contacting selected portions of the hair for an accent streaking or highlighting effect, or touching up root portions of the hair.

While the present invention is capable of various modifications and alternate constructions, it is not intended to limit the invention to the specific embodiments disclosed herein. Rather, it is intended to cover all modifications and alternative constructions falling within the spirit and scope of the invention as expressed in the claims.

What is claimed is:

1. An application device comprising:

a hair product;

a main body having an interior portion defining a reservoir for receiving the hair product, a first portion, and an opening for accessing the reservoir;

a collar having a second portion, the second portion detachably engaging with the first portion of the main body to detachably couple the collar to the main body;

a wick having a first end and a second end, the second end having a serrated tip for applying the hair product to the hair, the wick extending through the collar;

wherein the first end of the wick is disposed in the reservoir of the main body, and the second end of the wick is disposed outside of the main body when the collar is detachably coupled to the main body, and wherein the hair product is conveyed from the first end of the wick to the second end of the wick.

2. The application device according to claim 1, wherein the hair product is a hair coloring substance.

3. The application device according to claim 1, wherein the first portion of the main body includes a first threaded portion, wherein the second portion of the collar includes a second threaded portion, wherein the first threaded portion is threaded complementarily to the second threaded portion.

4. The application device according to claim 1, wherein the collar may be detached from the main body without affecting a structural integrity of the application device.

5. The application device according to claim 1, wherein the opening includes a neck for supporting the wick.

6. The application device according to claim 1, further comprising a cap adapted to cover the second end of the wick and adapted to sealingly connect to the main body.

7. The application device according to claim 6, wherein the main body contains threads which engage corresponding threads on the cap to seal the cap with the main body.

8. The application device according to claim 6, wherein the cap seals by press fit onto the main body.

9. The application device according to claim 6, wherein the cap seals with the main body by parallel grooves cooperating with the main body.

10. The application device according to claim 1, wherein the collar is provided with threads which engage corresponding threads of the main body.

11. The application device according to claim 1, wherein the wick comprises sponge rubber.

12. The application device according to claim 1 further comprising a flexible plastic casing disposed within the reservoir between the hair product and the main body for separating the hair product from the main body, the flexible plastic casing having an opening substantially coincident with the opening of the main body to allow passage of the wick therethrough.

13. The application device according to claim 1, wherein the wick comprises fibre.

14. The application device according to claim 1 further comprising a spacing element disposed within the main body adjacent the reservoir wherein the main body encompasses the spacing element and the reservoir.

15. The application device according to claim 1, further comprising an absorbent material disposed within the reservoir for absorbing the hair product, the absorbent material being in fluid communication with the first end of the wick, wherein the hair product may pass from the absorbent material to the wick.

16. The application device according to claim 1, wherein the main body further comprises:

at least one additional reservoir adjacent to the reservoir and separated from the reservoir by a partition, the at least one additional reservoir having an interior, an exterior, and a port by which the interior communicates with the exterior, the at least one additional reservoir receiving a second hair product; and at least one additional wick disposed in the port, the at least one additional wick having a first portion disposed in the at least one additional reservoir and a second portion disposed outside the at least one additional reservoir.

17. The application device according to claim 1, further comprising:

a utility compartment adjacent to the main body, the utility compartment receiving a cosmetic product, the utility compartment having a utility cap adapted to fit thereon.

18. The application device according to claim 17, wherein the utility cap further includes an applicator brush attached thereto.

19. The application device according to claim 17 wherein the cosmetic product comprises a small, shiny, sparkling, metallic-like component for visual enhancement of the hair or skin.

20. The application device according to claim 1, further comprising a brush disposed adjacent the main body.

21. The application device according to claim 1, further comprising a comb disposed adjacent the main body.

22. The application device according to claim 1, wherein the wick comprises felt.

23. A method of applying a hair product to hair using a hair product application device, wherein the hair product comprises one or more components, wherein the hair product application device includes a main body having a reservoir and an opening, a collar detachably coupling to the main body and having a through-hole, a wick extending through the through-hole of the collar and the opening of the main body, and being disposed with a first wick portion disposed in the reservoir and a second wick portion disposed outside the main body, wherein the hair product is contained in the reservoir, wherein the application device further includes a valve separating the reservoir into a first compartment and a second compartment, the second compartment having the opening through which the wick is disposed with the first wick portion disposed in the second compartment and the second wick portion disposed outside the main body, the method comprising the steps of:

detaching the collar from the main body to access the reservoir of the main body for performing at least one of a refilling or a changing of the hair product;

detachably coupling the collar to the main body;

shaking the application device such that the one or more components of the hair product in the first compartment are mixed together, opening the valve such that the hair product in the first compartment may pass through the valve into the second compartment and further may pass into contact with the first wick portion;

applying the second wick portion to the hair to transfer the hair product from the second wick portion to the hair; and closing the valve so that the hair product in the first compartment is substantially separated from the wick in the second compartment.

24. An application device comprising:

a hair product;

a main body having an interior portion, an opening for accessing the reservoir and an exterior portion;

a valve element disposed in the interior portion of the main body, the valve element isolating a first portion of the interior portion of the main body from a second portion of the interior portion of the main body in a first closed configuration, the second portion defining a reservoir for receiving the hair product, the valve element enabling the hair product to flow between the first portion and second portion of the interior portion of the main body in a second open configuration;

a wick having a first end extending into the first portion of the interior portion of the main body and a second end disposed outside of the main body, the wick extending through the opening in the main body;

wherein the valve element is biased between the first closed configuration and the second open configuration by applying a predetermined amount of force to the exterior portion of the main body in an area adjacent to the second portion of the interior portion of the main body.

25. The application device according to claim 24, wherein the main body includes a longitudinal axis, and wherein the valve element is biased between the first closed configuration and the second open configuration by applying a predetermined amount of force to the exterior portion of the main body in a direction substantially perpendicular to the longitudinal axis of the main body in an area adjacent to the second portion of the interior portion of the main body.

26. An application device comprising:

a hair product;

a main body having an interior portion defining a reservoir for receiving the hair product, a first portion, and an opening for accessing the reservoir;

a collar having a second portion, the second portion detachably engaging with the first portion of the main body to detachably couple the collar to the main body; and a single-piece wick having a first end and a second end, the single-piece wick extending through the collar, wherein the first end of the single-piece wick is disposed in the reservoir of the main body, and the second end of the single-piece wick is disposed outside of the main body when the collar is detachably coupled to the main body, and wherein the hair product is conveyed from the first end of the single-piece wick to the second end of the single-piece wick.

27. A method of applying a hair product to hair using a hair product application device, the hair product comprising one or more components, wherein the hair product application device includes a main body having a reservoir and an opening through which a wick is disposed with a first wick portion disposed in the reservoir and a second wick portion disposed outside the main body, the device further having a cap that covers the second wick portion and seals with the main body, wherein the hair product is contained in the reservoir, and wherein the application device further includes a valve separating the reservoir into a first compartment and a second compartment, the second compartment having the opening through which the wick is disposed with the first wick portion disposed in the second compartment and the second wick portion disposed outside the main body, the method comprising the steps of:

shaking the application device such that the one or more components of the hair product in the first compartment are mixed together, opening the valve to allow the hair product in the first compartment to pass through the valve into the second compartment and to contact the first wick portion;

removing the cap from the main body to expose the second wick portion;

applying the second wick portion to the hair to transfer the hair product from the second wick portion to the hair;

closing the valve so that the hair product in the first compartment is substantially separated from the wick in the second compartment;

replacing the cap over the second wick portion and engaging the cap with the main body of the applicator device to form a substantially air tight enclosure between the cap and the main body wherein the second wick portion resides.

* * * * *